US007798380B2

(12) United States Patent
Chekroune

(10) Patent No.: US 7,798,380 B2
(45) Date of Patent: Sep. 21, 2010

(54) PLASTIC DRINKS BOTTLE SUPPORT

(76) Inventor: Philippe Chekroune, 18 rue Beaufils, F-93120 La Courneuve (FR)

( * ) Notice: Subject to any disclaimer, the term of this patent is extended or adjusted under 35 U.S.C. 154(b) by 290 days.

(21) Appl. No.: 11/667,154

(22) PCT Filed: Nov. 3, 2005

(86) PCT No.: PCT/FR2005/050925

§ 371 (c)(1),
(2), (4) Date: Feb. 7, 2008

(87) PCT Pub. No.: WO2006/048584

PCT Pub. Date: May 11, 2006

(65) Prior Publication Data

US 2009/0008525 A1 Jan. 8, 2009

(30) Foreign Application Priority Data

Nov. 4, 2004 (FR) ..... 04 52526

(51) Int. Cl.
*A45F 3/16* (2006.01)

(52) U.S. Cl. ..... 224/148.4; 224/148.7; 224/251; 248/312

(58) Field of Classification Search ..... 224/148.4, 224/148.7, 251, 268, 269; 248/312, 311.2, 248/314; 220/737
See application file for complete search history.

(56) References Cited

U.S. PATENT DOCUMENTS

| | | | | | |
|---|---|---|---|---|---|
| 5,143,236 | A * | 9/1992 | Gueret | 215/311 |
| 5,332,090 | A * | 7/1994 | Tucker | 206/315.3 |
| 5,816,396 | A * | 10/1998 | Shin | 206/315.3 |
| 5,865,412 | A * | 2/1999 | Mason | 248/311.2 |
| 5,906,303 | A | 5/1999 | Carone et al. | 224/251 |
| 6,019,335 | A | 2/2000 | Sehati | 248/312 |
| 6,045,017 | A * | 4/2000 | Connell | 224/148.7 |
| 6,349,844 | B1 | 2/2002 | Betras | 220/709 |
| 6,837,472 | B1 * | 1/2005 | Beutz | 248/312 |
| 2004/0013030 | A1 * | 1/2004 | Renz | 366/130 |
| 2004/0108346 | A1 * | 6/2004 | Pablo | 224/251 |
| 2008/0083798 | A1 * | 4/2008 | Broadwell et al. | 224/269 |

FOREIGN PATENT DOCUMENTS

| | | | |
|---|---|---|---|
| FR | 2856901 | | 1/2005 |
| FR | 2857834 | | 1/2005 |
| WO | WO 2004078096 | * | 9/2004 |

* cited by examiner

*Primary Examiner*—Ramon O Ramirez
(74) *Attorney, Agent, or Firm*—Drinker Biddle & Reath LLP

(57) ABSTRACT

The invention relates to a plastic drinks bottle support. The inventive support (1) comprises an anchoring member (2) and a ring (3). The anchoring member (2) takes the form of a clamp that is intended to be fixed to a belt or hooked onto the edge of a pocket. The clamp (2) comprises two prongs, namely an outer prong (21) and an inner prong (22). The aforementioned ring (3) comprises an internal elastic lip (4) which projects out from the inner edge of the ring (3) in order to reduce the cross-section thereof.

18 Claims, 2 Drawing Sheets

PLASTIC DRINKS BOTTLE SUPPORT

FIELD OF THE INVENTION

Figure 1A:
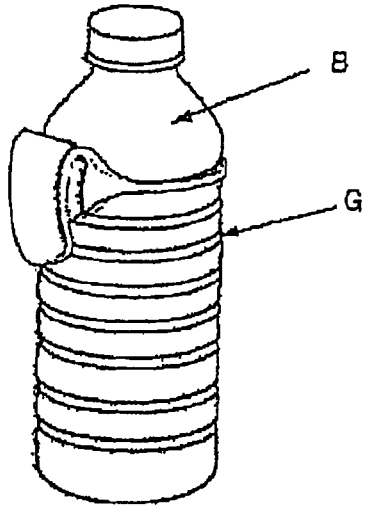

The present invention relates to a drinks bottle support made from flexible plastics material of which the body having a standard cylindrical shape includes at least one local ringed zone forming at least one peripheral groove, comprising an anchoring member in the form of a clamp for fixing on the belt or an item of clothing (pocket) and a ring connected to the clamp in order to receive the bottle.

PRIOR ART

Various devices already exist for attaching objects to a belt or to an item of clothing. Thus the document FR 01 09 364 describes a fastener for fixing a pair of spectacles. This fastener in the form of a clamp attaches to the belt or to a pocket and has a hole for one arm of the spectacles to pass through as well as a recess to receive the two arms of the spectacles, folded back, in such a way as to hold the spectacles.

The document FR 95 13 615 relates to a support which is likewise of this type comprising a clamp and a fastener in which a walking stick is clipped so as to enable the stick to be carried without having to hold it.

Finally, the document FR 92 04 159 describes a flower holder clip also comprising a clamp and a recess into which a posy or a flower is introduced so that it can be carried attached to an item of clothing.

Finally, the document FR 03 14 192 describes a support for a bottle, cup or can. This device comprises a fastener which is attached to the belt or to an item of clothing and is extended by a vertical prong which serves for support against the user's body, this prong being oriented along the axis of the object to be received. The fastener has a horizontal arch with a cross-section corresponding to that of the object and the supporting prong ends in a return which forms a support for the base of the object such as a bottle. This device, which is perfectly suitable for bottles which are large and consequently heavy when they are full, has the drawback that it is relatively cumbersome when empty, in order to be joined directly to the packaged bottle, particularly if the bottle is packaged in a pack comprising a plurality of bottles.

OBJECT OF THE INVENTION

The object of the present invention is to develop a bottle support which has a simple shape and is less cumbersome, and which in particular can be joined to the bottle packaged alone or in a pack, in order to be distributed as an accessory joined to a bottle and to serve as an advertising aid in addition to being functional.

DESCRIPTION AND ADVANTAGES OF THE INVENTION

To this end the present invention relates to a bottle support of the type defined above, characterised in that the ring has a cross-section slightly greater than the standard cross-section of a bottle and it is provided internally with at least one resilient lip projecting into the aperture of the ring to reduce the diameter thereof and to be accommodated in a peripheral groove of the bottle in order to retain the bottle in the ring.

This support is extremely compact and enables a bottle of which the body comprises a ringed zone to be received and held well. The bottle is engaged simply by pushing it into the lip which deforms resiliently. The anchoring of the lip in the peripheral groove of the bottle is observed during the engagement movement of the bottle. The resilience of the lip thus engaged in the groove enables the bottle to be retained in the ring. In order to remove it and to use the bottle it is sufficient to exert a pulling force or even to release the clamp from the belt and leave the support attached to the bottle.

Such a support can also have advertising material on the periphery of the ring either in the form of an inscription or also a figurine or elements in relief which are situated outside the contour of the bottle and do not hamper the positioning of the bottle or the retention thereof in the ring.

This support can be easily put in place on the bottle at the time of bottling. The placing of the support can take place automatically in the bottling line. The slight relief on the support does not hamper the packaging of the bottle or grouping of the bottle into a batch of four or six bottles, wrapped in a stretch or retractable film.

Such a support could then be associated with a batch of bottles or one support could be associated with each bottle, as the case may be.

As the support is easily disengaged from the bottle, the same support could serve for all the bottles in the batch.

The lip is advantageously continuous over the periphery of the ring. However, it is equally possible to produce a discontinuous lip formed by segments distributed over the internal periphery of the ring.

According to another advantageous characteristic, the lip is divided. The ring then bears two lips, preferably spaced by the distance between two grooves of a bottle.

The lip can have a straight cross-section, that is to say it can project into the aperture of the ring, being directed perpendicularly to the axis of the bottle or to the surface of the ring. The lip is also preferably raised in order to form a V-shaped cross-section with the ring. The lip then functions as a catch, facilitating the movement of the ring with respect to the bottle in one direction and rendering it more difficult in the other direction.

As the lip is directed upwards, the bottle will be introduced into the ring by moving it downwards. The bottle will be removed in the same direction.

According to another advantageous characteristic, the support assembly comprising the clamp, the ring and the lip is made in one piece.

It is equally possible to make the clamp and the ring with its lip in the form of two pieces clipped into one another.

The lip can also be produced separately from the ring and from a different material which is more flexible than that of the ring which is preferably rigid, the ring having an internal groove in which the base of the lip engages.

DRAWINGS

Figure 1B:
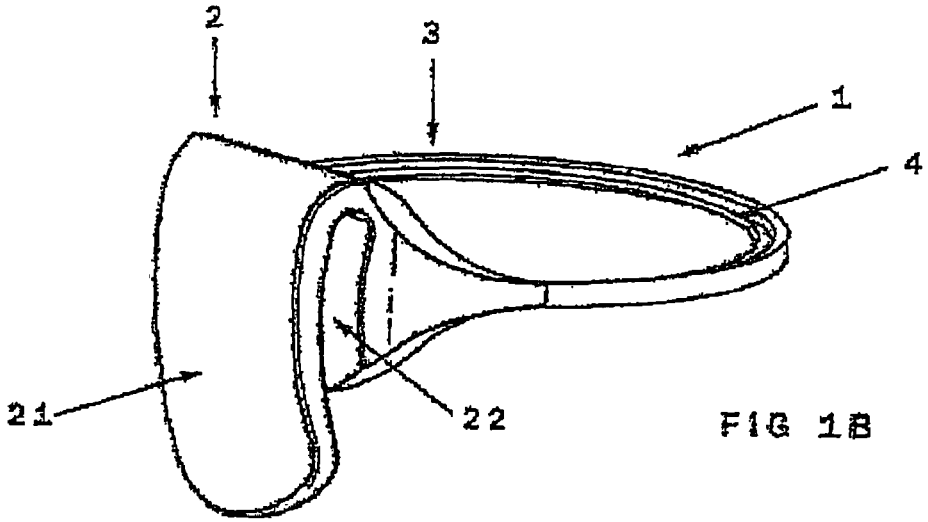
Figure 1C:
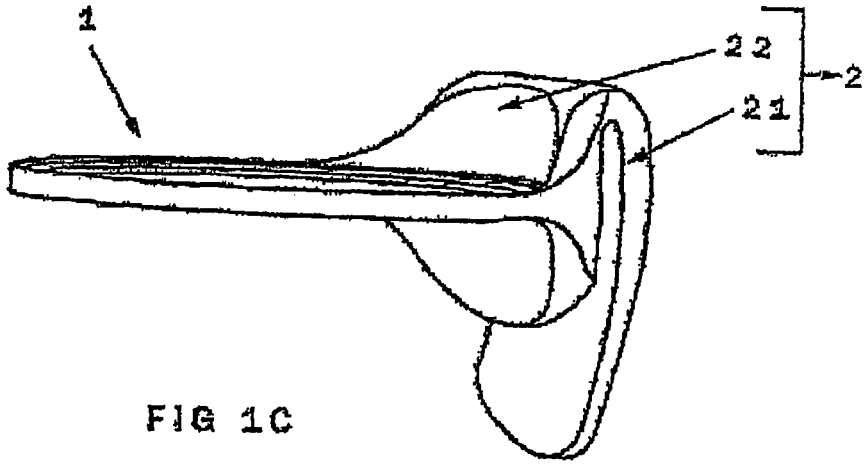
Figure 2A:
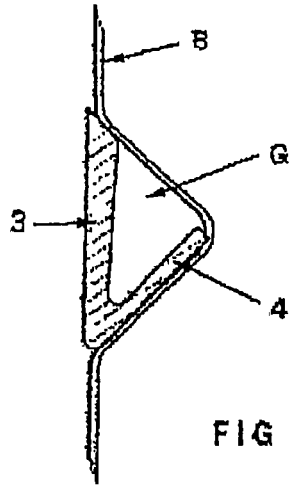
Figure 2B:
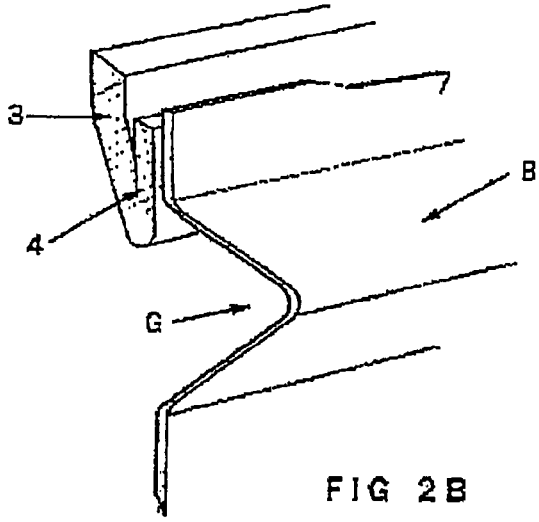
Figure 3B:
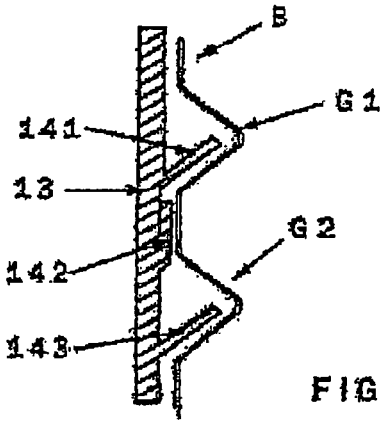
Figure 3A:
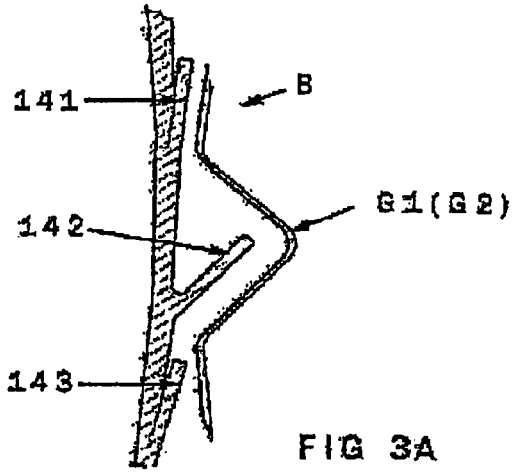
Figure 4:
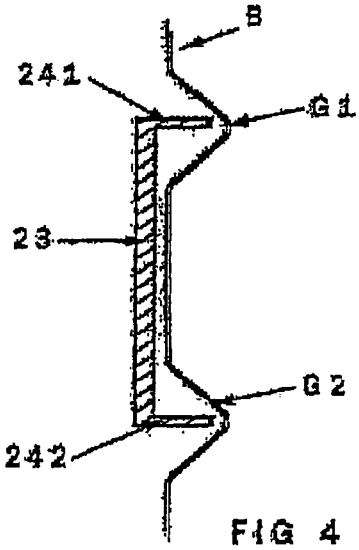
Figure 5:
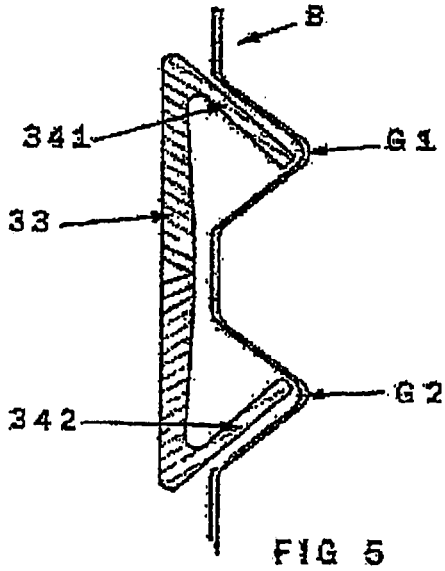

The present invention will be described below in greater detail with the aid of embodiments which are illustrated in the appended drawings, in which:

FIG. 1A shows a perspective view of a first embodiment of a support according to the invention, FIGS. 1B, 1C show perspective views of the support of FIG. 1A, FIG. 2A shows a partial sectional view on an enlarged scale of a part of the bottle in the region of a peripheral groove and of the ring provided with a V-shaped lip, engaged in the said groove, FIG. 2B shows a cutaway perspective view corresponding to FIG. 2A at the moment when the bottle B is put in place or removed, which then compresses the lip 4 before it can open out in the groove G as shown in FIG. 2A, FIG. 3A is a sectional view similar to that of FIG. 2A for another embodiment of a support with three peripheral lips, FIG. 3B shows the placing of a bottle in the ring of the support shown in part in FIG. 3A, FIG. 4 shows another embodiment of the ring, FIG. 5 shows a schematic sectional view of another embodiment of a ring for a support according to the invention.

DESCRIPTION OF THE EMBODIMENTS

According to FIG. 1A, the invention relates to support made from flexible plastics material for a drinks bottle B. Such bottles have a cylindrical cross-sectional shape which is more or less standard or is at least close for different manufacturers according to the volume of the bottle (33 centiliters, ½ liter, 1 liter of 1.5 liters).

These bottles made from flexible plastics material generally have a cylindrical body of circular, square or rectangular cross-section with a ringed zone with grooves G to increase the rigidity of the bottle in spite of the very reduced thickness of the plastics material. These ringed zones also make it easier to compress the empty bottle before disposing of it.

The support 1 according to FIGS. 1B, 1C comprises an anchoring member 2 in the form of a clamp intended to be fixed on the belt or to be hooked onto the edge of a pocket. This clamp 2 comprises two prongs, namely an outer prong 21 and an inner prong 22. The outer prong is relatively flat, whilst the inner prong is preferably curved in a shape adapted to that of the bottle B, and will also be flat if the support is intended to receive a bottle with a square or rectangular cross-section.

FIGS. 1A, 1B, 1C show the example of a support intended to receive a bottle B of circular cross-section. The inner widened prong 22 of the clamp 2 bears the circular ring 3 which has a cross-section slightly greater than the cross-section of this type of bottle such that the ring 3 can engage freely over the bottle.

This ring 3 has an internal resilient lip 4 which projects into the inner contour of the ring 3 to reduce the cross-section thereof. The reduced cross-section is then smaller than the cross-section of the bottle B and preferably is even slightly smaller than the more reduced cross-section of a groove of the body of the bottle.

The various embodiments of the lip are shown in FIGS. 2A to 5 by partial sectional views of one side of the ring and of the lip or lips as well as of the part of the bottle on an enlarged scale. According to the embodiment in FIGS. 2A, 2B the upwardly turned lip 4 projects and forms a V-shaped cross-section with the ring 3. The ring 3 is preferably rigid due to its thickness or the material from which it is made, whilst the lip 4 is preferably relatively flexible so as to be able to be deformed and to pass over the body of the bottle B and open out resiliently in the groove G.

FIG. 2A shows clearly that the ring has a cross-section greater than that of the body of the bottle, whilst the lip has a smaller cross-section, at least in the anchoring position, the cross-section of the lip enabling it to engage resiliently in the peripheral groove G of the bottle B. The folded-back position of the lip as the bottle B passes through is shown in section and in perspective in FIG. 2B.

FIGS. 3A, 3B show an embodiment of a ring 13 provided with three lips 141, 142, 143, of which two are engaged in a peripheral groove G1, G2 of the bottle B, the other remaining compressed. The spacing of the lips 141, 142 corresponds substantially to the spacing of the grooves G1, G2. With the ring 13 these lips also form elements with V-shaped cross-sections.

As in FIG. 3B, the bottle is introduced into the ring 13 by passing it downwards. This movement then of necessity compresses the lips 141 to 143 and, when they are located facing the peripheral grooves G1, G2 of the bottle, they expand and open out in the grooves in order to retain the bottle, forming anchoring members which press into the grooves (FIG. 3A).

FIG. 4 shows a view of details similar to that of FIG. 3A but for a ring 23 provided with two straight lips 241, 242 which enter the grooves G1, G2 of the bottle B. The lips are straight with respect to the surface of the ring 23. Thus, instead of being inclined, the lips are substantially perpendicular to the axis of the ring (or of the bottle).

FIG. 5 shows a partial sectional view similar to the preceding views showing another embodiment of a ring 33 bounded by two lips 341, 342 spaced substantially by the distance between two grooves G1, G2 of a bottle B and which are directed towards one another and not in the same direction as in FIGS. 3, 3B.

These lips 341, 342 engage more or less in the grooves G1, G2 according to the spacing between them and the spacing between the grooves, wherein this spacing can vary from one type of bottle to the other.

In the different embodiments above, the lips are continuous over the entire periphery of the ring. They can also be divided in order to exhibit more flexibility or can be formed by separate segments. The lips are produced from the same material as the ring but with a reduced thickness. The lips can also be made from a flexible material and can be clipped onto or attached to the ring which will be made from a more rigid material.

The ring can bear inscriptions, particularly advertising material. The ring can also bear figurines or logos in relief produced in the material.

The invention claimed is:

1. A support for a drink bottle made from flexible plastics material, the bottle comprising a body having a standard cylindrical shape that includes at least one local ringed zone forming at least one peripheral groove, the support comprising an anchoring member in the form of a clamp for fixing on the belt or an item of clothing (pocket) and a rigid ring connected to the clamp in order to receive the bottle, wherein:

the ring has a cross-section slightly greater than the standard cross-section of a bottle, the ring is provided internally with at least one flexible, resilient lip projecting into the aperture of the ring to reduce the diameter thereof and adapted to be accommodated in a peripheral groove of the bottle in order to retain the bottle in the ring.

2. Bottle support according to claim 1, wherein the lip is continuous over the periphery of the ring.

3. Bottle support according to claim 1, wherein the lip is formed by segments distributed over the internal periphery of the ring.

4. Bottle support according to claim 1, wherein the lip is divided.

5. Bottle support according to claim 1, wherein the lip has a straight cross-section, substantially perpendicular to the surface of the ring.

6. Bottle support according to claim 1, wherein the lip is raised relative to the ring in order to form a V-shaped cross-section with the contour of the ring.

7. Bottle support according to claim 1, wherein the ring and the lip are produced in one piece from moulded plastics material.

8. Bottle support according to claim 1, wherein an inner prong of the clamp is adapted to the shape of the bottle, and is curved for a bottle of curved shape and flat for a bottle with a square or rectangular cross-section.

9. A support for a plastic drink bottle that includes a body having a zone of standard cross-section comprising at least one peripheral groove, the support comprising:

an anchoring member in the form of a clamp for fixing on a belt, pocket, or other item of clothing; and a rigid ring connected to the clamp to receive the bottle, the ring having a cross-section slightly greater than the standard cross-section of a bottle;

wherein the ring is provided internally with at least one flexible, resilient lip projecting into the aperture of the ring to reduce the diameter thereof and adapted to be accommodated in a peripheral groove of the bottle in order to retain the bottle in the ring.

10. Bottle support according to claim 9, wherein the lip is continuous over the periphery of the ring.

11. Bottle support according to claim 9, wherein the lip is formed by segments distributed along the internal periphery of the ring.

12. Bottle support according to claim 9, wherein the lip is divided.

13. Bottle support according to claim 9, wherein the lip has in an unstressed condition a straight cross-section, substantially parallel to the plane of the ring.

14. Bottle support according to claim 9, wherein the lip in an unstressed condition projects so as to form a V-shaped cross-section with the contour of the ring.

15. Bottle support according to claim 9, wherein the ring and the lip are produced in one piece from molded plastics material.

16. Bottle support according to claim 9, wherein the clamp comprises an inner prong adjacent to the ring and an outer prong, and the inner prong conforms to the standard shape of the bottle.

17. Bottle support according to claim 16 for a bottle of curved shape, wherein the inner prong of the clamp is curved.

18. Bottle support according to claim 16 for a bottle with a square or rectangular cross-section, wherein the inner prong of the clamp is flat.

* * * * *